United States Patent [19]

Bammate

[11] Patent Number: 4,903,426

[45] Date of Patent: Feb. 27, 1990

[54] DEVICE FOR RECOVERING OF CARTRIDGE CASES FOR A SHOULDER WEAPON

[75] Inventor: Timour Bammate, Paris, France

[73] Assignee: Marianne Bammate

[21] Appl. No.: 357,984

[22] Filed: May 26, 1989

[30] Foreign Application Priority Data

Jun. 1, 1988 [CH] Switzerland ..... 63-02085

[51] Int. Cl.[4] ..... F41C 27/00

[52] U.S. Cl. ..... 42/98

[58] Field of Search ..... 42/98, 99; 24/303

[56] References Cited

U.S. PATENT DOCUMENTS

| | | | |
|---|---|---|---|
| 663,262 | 12/1900 | Dietrich | 42/98 |
| 1,201,189 | 10/1916 | Johnson | 42/98 |
| 3,153,981 | 10/1964 | Brass | 42/98 |
| 3,156,991 | 11/1964 | Adams | 42/98 |
| 3,739,685 | 6/1973 | Lundgren | 42/98 |
| 3,749,301 | 7/1973 | Peckar | 24/303 |
| 4,020,738 | 5/1977 | Martinez | 42/98 |
| 4,594,803 | 6/1986 | Muncy | 42/98 |
| 4,715,141 | 12/1987 | Kohnke | 42/98 |

*Primary Examiner*—Charles T. Jordan
*Assistant Examiner*—Michael J. Carone
*Attorney, Agent, or Firm*—Anthony J. Casella; Gerald E. Hespos

[57] ABSTRACT

The device comprises a support (4, 8, 9) fastened by gripping to engagement surfaces (14, 15) of a weapon (1) to which there is attached, by articulation around a hinge (5), a container (6) which in a swung-down bottom position covers the loading handle (2) and the window (3) for the ejection of the cases of the cartridges fired. The container (6) has an inner case-retention wall (13, 17) rising up to the window (3). A system for the immobilizing of the container (6) by ratchet (10, 11, 12) in three positions (18, 19, 20) makes it possible temporarily to maintain the container in a bottom position (18) in order to collect the cases (21), in an intermediate position (19) in order to permit the handling of the loading handle (2) and possibly of the members concealed in the bottom position without losing the cases collected, and in a top position (20) in order to recover the cases collected, which fall by gravity, and in order to permit easy inspection of the cartridge chamber.

4 Claims, 1 Drawing Sheet

DEVICE FOR RECOVERING OF CARTRIDGE CASES FOR A SHOULDER WEAPON

BACKGROUND OF THE INVENTION

The object of the present invention is a device for recovering cartridge cases for a shoulder weapon such as an automatic or semiautomatic assault gun having a loading handle and a window for the ejecting of the cases of.the cartridges fired.

This device is of the type comprising a support provided with means for its temporary attachment to the weapon, a container connected to the support and having an entrance opening intended to present itself in front of the case ejection window in order to collect the cases and means to permit the recovery of the cases collected in the container.

Devices of this type have already been designed in order to attempt to solve the problems inherent in the recovering of cartridge cases.

This recovery is motivated by the high cost of the cartridges produced and by the rarity of cartridges of certain calibers, which cost and rarity induce practically all sports marksmen to recover and reload the cartridge cases themselves, with further more a beneficial effect on the precision of the firing.

In the absence of a particularly appropriate device, the recovering of the cases is frequently difficult as they may be ejected to a distance several meters away from the marksman, in different directions and frequently in front of the firing path.

In order to limit the loss of cases, the marksmen are led to set up all kinds of screens in the vicinity of the ejection window of the weapon, which is scarcely practical or very effective in view of the fact that the cases ejected do not necessarily assume the same trajectory and may pass to the side of these screens and ricochet in unexpected directions.

It is furthermore customary to see marksmen, after the end of the firing, leave on a search for cases, which are frequently far from the place where they were. The cases found are not necessarily those of the marksman who collects them and it is unpleasant for a serious marksman to reload cases with regard to which he does not know how many times they have already been used nor to what load they have already been subjected.

With the known recovering arrangements of the abovementioned type to which the invention refers, these problems are solved in a manner which is more or less practical depending on the design thereof, as a result of the fact that the container is associated with the weapon and that the cases which are collected therein can only be those of the marksman.

In one of these devices, described in U.S. Pat. No. 4,204,353, the support is screwed onto the frame of the weapon and the container is removable and can be fastened to the support by a locking system with spring-actuated bolt which can be engaged in a keeper of the support. A part of the wall of the container which is located on the side of the ejection window rises towards and below the window and rests against the frame, while the locking by bolt and keeper is located at the upper part of the container, with the result that the holing of the container against the ejection window is assured simply by gravity.

In this device, the cases collected are recovered by detachment of the container from its support, by manual pressure exerted on the spring-actuated bolt.

In another device, described in U.S. Pat. No. 4,028,834 and which is of a slightly different type, the support has the shape of an open-bottom housing presenting a lateral opening located opposite the ejection window of the weapon, and the container is formed of a removable bag of netting which is fastened by clipping on the contour of the open bottom of the support. On its side, the support is removably fastened to the weapon by a system consisting of angle iron and elastic gripping collar which act on the top and the contour respectively of the frame of the weapon.

In this device, the cases ejected are also recovered by detachment of the container from its support.

However, these two known devices have, as counterpart of the advantage relative to the recovery of the cases, drawbacks with regard to certain operations of control and manipulation of the weapon due to the parts which are covered or concealed by the container when it is in position of use.

This is also true with respect to the cartridge chamber, which must be capable of being inspected easily by the marksman or the fire director, for instance at the end of a firing, in order to make certain of the absence of a cartridge in the firing chamber, access to which must be facilitated in case of jamming.

This is true also with regard to the loading handle, which must be capable of being operated without interference, particularly during the course of practice firing by small series of bursts which require manual rearming after each series.

Finally, in certain cases, such as, for instance, in combat situations and on certain weapons, the access to the push-button or lever for the unlocking of the loader or else the "safety—shot by shot—burst" selector, must be able to be freed rapidly.

When these parts are covered by the container of these known devices, it is then necessary either to detach the container from its support, in the case of the first patent mentioned, or else to detach the assembly consisting of the support and its container in the case of the second patent mentioned. And this can become very difficult, as, for instance, in the case of practice firing by small series of bursts which require manual rearming after each series, or else dangerous in a combat situation in connection with the changes in loader and the manipulation of the fire selector.

Furthermore, the manipulations necessary for the detachments and particularly the successive reattachments of the container in order to recover the cases collected may be the cause of a loss of time and of nervous irritation.

OBJECT AND SUMMARY OF THE INVENTION

The object of the invention is to avoid said drawbacks by making it possible to simplify the manipulations of the case container and make them easier, as well as the controls and manipulations of the weapon which is equipped with it.

For this purpose, the device for the recovering of the cartridge cases in accordance with the invention is characterized by the fact that it comprises a connecting hinge between the support and the container, conferring upon the container the possibility of rotating from a bottom position in which its entrance opening is swung in front of the case ejection window to a top position in which the cases collected fall by gravity so as to permit their recovery, and means for immobilizing the container in order to be able to hold it temporarily in at least one of its possible positions by a retaining force which is capable of being overcome by manual rotation of the container.

In this way, the recovery of the cases collected in the container can be easily effected by simple turn of the hand, by simply swinging it from its bottom position to its top position, with the result of emptying its contents, and by this same turn of the hand, it is also easy to inspect the cartridge chamber.

This basic concept makes it possible to avoid acting on the means for the fastening of the support to the weapon, whatever they may be, as well as when they are independent of the weapon, such as, for instance, the means of fastening by hooking or clipping when they are associated or integrated therein, in whole or in part.

The drawbacks relative to the manipulating of the parts of the weapon which are covered by the container in the bottom position of use are avoided not only by the fact that they can be released by simply lifting the container but also by the selection of at least one position of temporary holding of the latter by its immobilizing means which avoids the necessity of holding it by one hand while the other hand is working.

Thus, for instance, in the case of a weapon in which the ejection window of the cases and the loading handle are covered by the container in the bottom position of use, it is advantageous to develop the device in accordance with an embodiment in which the means for the immobilizing of the container are adapted to be able to hold it temporarily in its top and bottom positions. In this case, the top position is determined not only by the purpose of freeing the cases which have been collected but also in order completely to free the loading handle. The temporary immobilization in the bottom position of the container furthermore makes it possible to avoid any loss of cases during the normal movements of the weapon in all positions of firing.

This embodiment is also suitable for weapons on which the push-button or lever for the locking of the loader or else the "safety - shot by shot - burst" selector or else the breech stop is covered by the container, for the same reasons of ease of access.

In another embodiment, adapted more particularly to firing practice and small series of shots and with a weapon on which the loading handle and the case ejection window are covered by the container in the bottom position of use, the device comprises means for immobilizing the container which are intended to hold it in an intermediate position located between the top position and the bottom position, and the container has a wall for the retaining of the collected cases intended to prevent them from falling out while the container is in said intermediate position. In this embodiment, which may be combined with the preceding one, the intermediate position of the container is selected here in such a manner as to completely free the access to the loading handle. This has the result that the loading handle can be manipulated in order to reload the weapon during the course of firing without causing the cases already collected to fall.

Finally, it is also possible to combine with a single position of immobilization of the container in a bottom position of use a certain stiffness of the connecting hinge between the support and the container, making it possible to place and leave the latter, without load, in a raised position, selected, for instance, in order to permit inspection of the cartridge chamber. This embodiment may be suitable for weapons on which the loading handle is spaced from the case ejection window and is not covered by the container of the recovery device in a bottom position of use.

Likewise in the case of weapons in which the force of ejection of the cases is not very high, it may prove sufficient to assure merely the immobilizing of the container in a top position, combined or not with a certain stiffness of the hinge in order to assure its being held in a bottom position.

On the basis of its different embodiments permitted by the basic design of the invention, combinations can be foreseen in accordance with the requirements, as will become clearly evident from the following description.

BRIEF DESCRIPTION OF THE DRAWINGS

The accompany drawing shows, by way of example, two embodiments of the object of the invention.

DETAILED DESCRIPTION OF THE PREFERRED EMBODIMENTS

Figure 1:
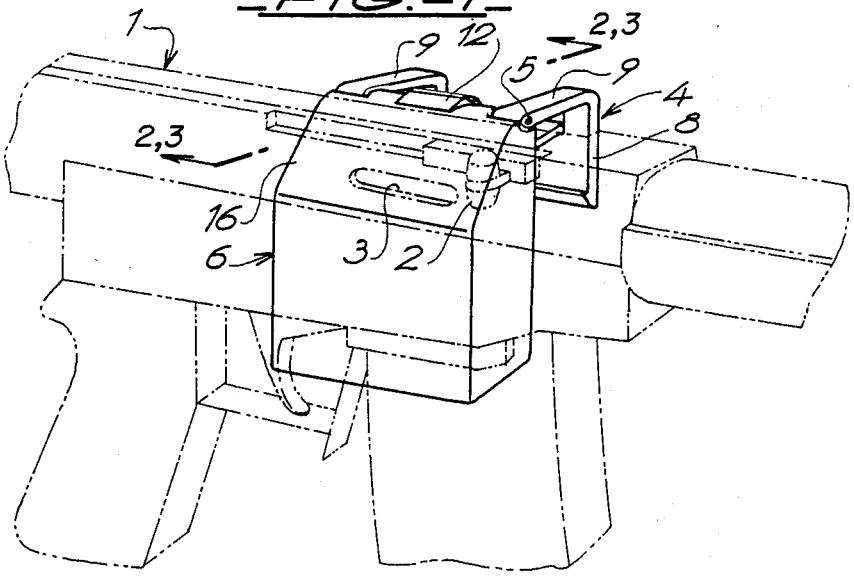
FIG. 1 is a view in perspective of the first embodiment.
Figure 3:
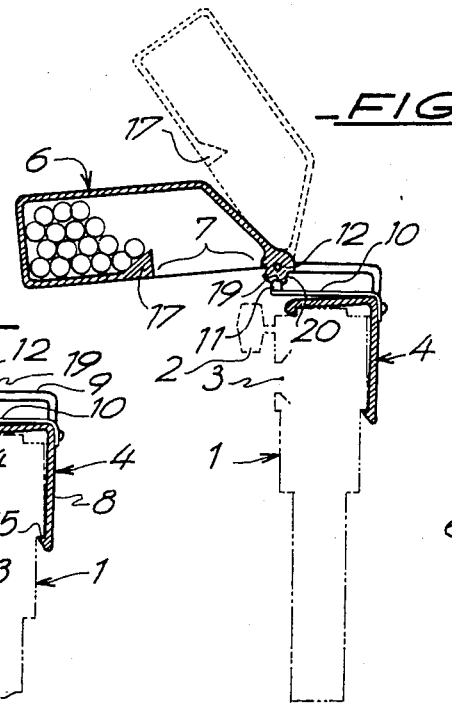
FIGS. 2 and 3 are median cross sections along the sectional axis I—I of FIG. 1, of the first embodiment.
Figure 2:
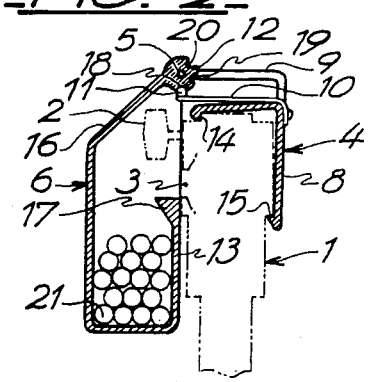

In its first embodiment, shown in FIGS. 1 to 3, the device is shown associated with an assault gun 1 shown in thin dot-dash lines, having a loading handle 2 and an ejection window 3 for the cases of the cartridges shot, which are located on the same side of the frame of the gun close to each other.

This device comprises a support 4 and a container 6 which are connected by a permanent connection hinge 5, as well as means for the temporary immobilizing of the container with respect to the support, which means are formed here by a ratchet member 12 centered on the axis of the hinge 5 and rigidly connected with the container 6 and by a holding pawl 11 pressed by means of a spring blade 10 against the ratchet member 12, the spring blade 10 being fastened to the support 4.

The support 4 is a part having an angle part 8 intended to be fastened by the elastic gripping of the curved ends of its two wings on natural gripping places of the frame of the weapon, which are formed here by wall 14 and 15 of different level.

Above the two ends of the angle piece 8 and firmly fastened to it, the support 4 has two parallel brackets 9 at the end of which there is articulated the pin of the hinge 5, forming two bearings for it. Between these two brackets and on the angle member 8 there is fastened the spring leaf 10 bearing the holding pawl 12.

The container 6 is a quadrangular box surrounding the loading handle 2 and having an entrance opening 7 intended to present itself in front of the case ejection window 3.

The front wall 16 of the container 6 forms substantially a dihedral, the inclined upper part of which is articulated at its end on the hinge 5, between the two brackets 9 of the support 4.

The rear wall 13 of the container 6, which is intended to be contiguous to the frame of the weapon 1 on the side of the case ejection window 3, extends upward to above the window and has the inner return 17 in the form of a trihedral protrusion the function of which will be explained further below.

Between the two brackets 9 of the support 4, the container 6 comprises, integral with its front wall 16, the ratchet member 12 already mentioned which, as can be clearly noted from FIGS. 2 and 3, has three ratchet grooves 18, 19 and 20 distributed on its periphery and intended to permit the holding of the container 6 in three different positions by engagement of the pawl 11.

The retaining force of the immobilization system is so determined as to be able to be overcome by manual rotation of the container 6 and also not to disengage, once the container is loaded with cases, upon the normal manipulations of the weapon, in all firing positions.

The engagement of the pawl 11 in the first groove 18 of the ratchet member 12 assures the holding fast of the container 6 in its bottom position, as shown in FIG. 2, by which it is applied against the frame of the weapon and by which the cases ejected through the ejection window 3 pass through the opening 7 and fall for collection into the container.

In normal firing position, the container 6 is left in this bottom position until it is full, its volume being advantageously designed, for instance, to assure the storing of a number of cases corresponding to at least the quantity of cartridges of a large-capacity loader.

In the case of firing in small series with intermediate refilling, as for instance in the case already indicated of special practice firings, access to the loading handle 2 is obtained by pivoting the container 6 by about 90° into an intermediate position, as shown in FIG. 3, in which the pawl 11 is engaged into the second groove 19 of the ratchet member 12.

In this intermediate position, the loading handle 2 can be used for the manual reloading of the weapon and the cases already collected are held in the container 6 by the obstacle formed by the trihedral inner return 17 of the inner wall 13.

In the two said firing situations, once the container 6 has been filled, the recovering of the cases collected is made easy by the pivoting into upper position of the container, in which the pawl 11 comes into the third groove 20 of the ratchet member 12, as shown in thin dashed lines in the same FIG. 3.

In this position, the trihedral protrusion 17 of the wall 13 of the container no longer constitutes a retention, due to its change in orientation, and it releases the cases 21 which drop by gravity in order to be recovered. The immobilization of the container in top position furthermore permits easy inspection of the cartridge chamber of the weapon as well as all manipulations made necessary, for instance by jamming, without constituting a disturbance for the marksman.

In the course of firing, and when certain parts of the weapon, for instance the fire selector, are covered by the container 6 in its bottom position, the marksman can lift and immobilize the latter in its intermediate position and actuate these members by a single hand without thereby causing the cases already collected to fall.

Figure 4:
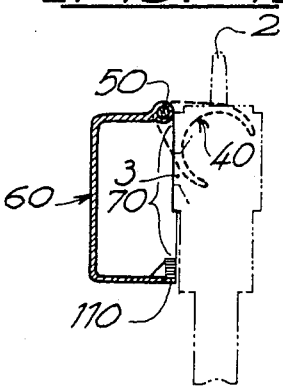
FIG. 4 is a median cross section through the second embodiment.

In its second embodiment, shown in part in FIG. 4, the recovery device is fitted to an assault gun having a loading handle 2 and an ejection window 3 for the cartridge cases which are spaced from each other, the loading handle 2 being in this case on the top of the weapon while the ejection window 3 is on the side thereof.

This device is formed here also of a container 60 and a support 40 which are connected by a hinge 50.

The container 60 and the support 40 are spaced apart here in the longitudinal direction of the weapon. The support 40, shown in dashed lines, is formed by an elastic gripping collar engaged around a part of the frame of the weapon surrounding the barrel, in front of the space occupied by the ejection window 3 and the loading handle 2, and it bears, overhung in the manner of a bayonet, the pin of the hinge 50 between these two elements.

The container 60 is without an inner wall here and bears via its side walls against the frame of the weapon, shown in its bottom position, its entrance opening 70 extending over its entire surface on the side of the weapon.

The container 60 is immobilized here in its bottom position by a magnet 110 fastened to its wall opposite a metal element of the frame of the weapon which may, of course, be formed very simply by the frame.

In this embodiment, the hinge 50 is thus arranged between the ejection window 3 and the loading handle 2, and the container in no way interferes with the manipulation of the latter.

The recovery of the cases collected is effected by a single turn of the hand in order to swing the container 60 into top position, which can be left free and not defined when the swinging of the container has no other purpose than to cause the cases to fall.

In order, furthermore, to facilitate the inspection of the cartridge chamber as well as the manipulation of the parts of the weapon which may be hidden by the container 60 in its bottom position, one suitable simple solution for this second embodiment consists in providing the hinge 50 with sufficient stiffness in order to be able to maintain the latter, empty, in a raised position selected so as to permit this inspection and these manipulations.

The force of retention of the magnet 110 is adapted here also to be overcome by manual rotation of the container 60 and not to disengage, once loaded with cases, due to the normal manipulations of the weapon in a firing position.

The structures of the two embodiments are not limitative, and changes may be made, in particular in the type of hinge between the support and the container and the means for the temporary immobilization of the latter with respect to the support as well as in the means for fastening the support to the frame of the weapon.

The dimensions and, in particular, the length of the container may vary depending on whether or not the loading handle is firmly attached to the breech of the weapon. Likewise, the shape of the container can be adapted to the surrounding configuration of the weapon, in particular in the case of weapons equipped with side-by-side multiple loaders, in which case the container can be provided with suitable notches.

For a weapon, the loading handle of which is firmly attached to the breech and follows the movements of the latter upon firing, when the container is adapted to cover it also, as in the first embodiment, it is necessary to provide either a sufficient length of the container in order to cover the entire course of the loading handle or a passage opening for same in the wall of the container.

It is also possible to combine between them the means of the two embodiments, in whole or in part, depending on what will be deemed necessary and sufficient.

For instance, in the case of the first embodiment and when the manipulations of the hidden members of the weapon and the inspection of the cartridge chamber can already be effected in the intermediate position of the container 6, the immobilizing of the latter in top position can be eliminated. In this case also, the bottom and intermediate positions can be assured by a magnet system, between the container and the frame of the weapon, in the case of the bottom position, like the magnet 110 of the second embodiment, and between the container and support in the case of the intermediate position.

All possibilities remain open for the selection of the manner of attachment of the case recovery device to the weapon without going beyond the scope of the invention, the attachments indicated by way of example in the two embodiments being in no way limitative.

The systems of hooking the supports 6 and 60 as shown are particularly suitable for existing weapons since they do not involve any modification of the weapons.

In the case of new weapons or in the case of new series of weapons, it is possible to provide, for instance, the part of the hinge connection to the weapon fastened to it, either permanently or by screwing, this part of the hinge constituting the support according to the invention in its most reduced form. This part of the hinge may also, along the same line, form an integral part of the weapon. An important saving may thus be obtained in the cost of the recovery device.

Another advantage of this last design adapted to new weapons resides in the fact that by the necessarily reduced size of the part of the hinge forming the support of the container it is easier to provide an installation which does not interfere with the possible attachment of a firing telescope.

Finally, in the design of a new weapon, it is contemplated to integrate the case container with the structure itself of the carcass of the weapon, in the manner of the protection flap of the case ejection window present on certain weapons, the function of which it will furthermore fulfill. In this case, by way of safety, the immobilization of the container in the operating position can be assured simply by a suitable stiffness of its hinge or other equivalent means so that the latter yields when the container designed in this manner is full, in order to avoid the risk of clogging and the jamming which could result therefrom.

I claim:

1. A device for recovering cartridge cases for a shoulder weapon having a loading handle and window for the ejection of the cases of the cartridges shot, comprising a support provided with means for the attachment thereof to the weapon, a container connected to said support, said container having an entrance opening intended to be positioned opposite said ejection window for the cases in order to collect the cases, and means to permit recovering of the cases collected in the container, comprising a connecting hinge between the support and the container imparting to the latter a possibility of rotation extending from a bottom position in which the entrance opening of the container is swung in front of the case ejection window to a top position in which the collected cases fall by gravity in order to permit their recovery, and means for immobilizing the container so as to be able to hold it temporarily in at least one of its possible positions by a force of retention capable of being overcome by manual rotation of the container, said means for immobilizing comprising means for immobilizing the container so as to be able to hold it in its top and bottom positions.

2. A device according to claim 1 wherein said means for immobilizing the container is adapted to be able to hold it in an intermediate position situated between its top position and its bottom position, and wherein said container has a wall for the retention of the collected cases which is intended to prevent the collected cases from falling when the container is in said intermediate position.

3. A device according to claim 1, wherein said means for immobilizing comprises, a ratchet member centered on the axis of said connecting hinge between the support and the container and fastened to one of said support and said container, and a holding pawl fastened to the other of said support and said container and pressed resiliently against ratchet member.

4. A device according to claim 1, wherein said means for immobilizing the container comprises means for immobilizing the container in its bottom position, and wherein said connecting hinge between the support and the container is provided with sufficient stiffness to maintain the container in a selected raised position when empty.

* * * * *